US005888942A

United States Patent [19]

Matthaei

[11] Patent Number: 5,888,942

[45] Date of Patent: Mar. 30, 1999

[54] TUNABLE MICROWAVE HAIRPIN-COMB SUPERCONDUCTIVE FILTERS FOR NARROW-BAND APPLICATIONS

[75] Inventor: George L. Matthaei, Santa Barbara, Calif.

[73] Assignee: Superconductor Technologies, Inc., Santa Barbara, Calif.

[21] Appl. No.: 668,093

[22] Filed: Jun. 17, 1996

[51] Int. Cl.[6] ..... H01P 1/203

[52] U.S. Cl. ..... 505/210; 505/700; 505/701; 505/866; 333/204; 333/205; 333/219

[58] Field of Search ..... 333/204, 205, 333/219, 995; 505/210, 700, 701, 866

[56] References Cited

U.S. PATENT DOCUMENTS

| | | | |
|---|---|---|---|
| 4,578,656 | 3/1986 | La Cour et al. | 333/205 |
| 4,992,759 | 2/1991 | Giraudeau et al. | 333/204 |
| 5,055,809 | 10/1991 | Sagawa et al. | 333/219 |

FOREIGN PATENT DOCUMENTS

| | | | |
|---|---|---|---|
| 71508 | 2/1983 | Japan | 333/204 |
| 193302 | 8/1987 | Japan | 333/204 |
| 204801 | 8/1988 | Japan | 333/204 |
| 206201 | 8/1990 | Japan | 333/204 |
| 1309125 | 5/1987 | Russian Federation | 333/204 |

OTHER PUBLICATIONS

"Concerning the Use of High–Temperature Supreconductivity in Planar Microwave Filters," GL Matthaei and GL Hey–Shipton *IEEE Trans. on MTT,* (Jul. 1994) vol. 42, pp. 1287–1293.

*Microwave Filters, Impedance–Matching Networks, and Coupling Structures*, GL Matthaei, L Young, and EMT Jones Artech House Books, Dedham, MA, 91980, pp. 497–506 and 516–518.

"Hairpin–Line and Hybrid Hairpin–Line/Half–Wave Parallel–Coupled–Line Filters," EG Cristal and S Frankel *IEEE Trans. MTT*, (Nov. 1972) vol. MTT–20, pp.719–728.

"Parallel–Couped Transmission–Line–Resonator Filters," SB Cohn *IRE Trans. PGMTT*, (Apr. 1958) vol. MTT–6, pp. 223–231.

"Miniaturized Hairpin Resonator Filters and Their Appication ot Receiver Front–End MIC's," M Sagawa, K Takahashi, and M Makimoto *IEEE Trans. MTT*, (Dec. 1989) vol. 37, pp. 1991–1997.

"Novel, Staggered Resonator Array Superconducting 2.3–GHz Bandpass Filters," GL Mattaei and GL Hey–Shipton *IEEE Trans. MTT*, (Dec. 1993) vol. 41, pp. 2345–2352.

*Primary Examiner*—Benny T. Lee
*Attorney, Agent, or Firm*—Lyon & Lyon LLP

[57] ABSTRACT

Microwave hairpin-comb filters utilize a plurality of hairpin (i.e., folded) half-wavelength microstrip or stripline resonators arranged side-by-side and all with the same orientation. The coupling regions between resonators extend parallel to the sides of the resonators for substantially ⅛ to ¼ wavelength at the frequency of resonance of the resonators. This length of coupling region between resonators, along with all resonators being oriented in the same direction, result in resonance effects in the coupling regions between the resonators. These effects greatly reduce the couplings between the resonators so that the resonators can be very closely spaced so as to produce a compact filter structure yet still have a narrow passband. For example, a compact narrow band filter structure is possible using high-Q nominally half wavelength hairpin resonators. The structure can also be made to produce poles of attenuation adjacent to the passband in order to enhance the filter cutoff characteristic. The filter structure can be conveniently tuned using asymmetric dielectric pieces which rotate above an interdigital conductor or other two conductors pattern placed between the open ends of each resonator, the axis of rotation being normal to the substrate. This manner of tuning is particularly attractive for narrow-band, very low loss, high temperature superconductor (HTS) filters since these tuners can be made to give smooth tuning with no normal metal parts in the circuit and with no ground connections required. Such normal metal parts or ground connections would introduce considerable loss and degrade the HTS filter performance.

13 Claims, 12 Drawing Sheets

TUNABLE MICROWAVE HAIRPIN-COMB SUPERCONDUCTIVE FILTERS FOR NARROW-BAND APPLICATIONS

FIELD OF INVENTION

The present invention relates to microwave filters for narrow-band applications, and, more particularly, to microwave hairpin-comb filters for narrow-band applications which may be formed from high-temperature-superconductor films.

BACKGROUND

Filters have long been used in the processing of electrical signals. For example, in communications applications, such as microwave applications, it is desirable to filter out the smallest possible passband and thereby enable dividing a fixed frequency spectrum into the largest possible number of bands.

Such filters are of particular importance in the telecommunications field (microwave band). As more users desire to use the microwave band, the use of narrow-band filters will increase the actual number of users able to fit in a fixed spectrum. Of most particular importance is the frequency range from approximately 800–2,200 MHz. In the United States, the 800–900 MHz range is used for analog cellular communications. Personal communication services are planned for the 1,800 to 2,200 MHz range.

Historically, filters have fallen into three broad categories. First, lumped element filters have used separately fabricated air wound inductors and parallel plate capacitors, wired together to form a filter circuit. These conventional components are relatively small compared to the wave length, and accordingly, make for a fairly compact filter. However, the use of separate elements has proved to be difficult to manufacture, resulting in large circuit to circuit variations. The second conventional filter structure utilizes three-dimensional distributed element components. These physical elements are sizeable compared to the wavelength. Coupled bars or rods are used to form transmission line networks which are arranged as a filter circuit. Ordinarily, the length of the bars or rods is ¼ or ½ of the wavelength at the center frequency of the filter. Accordingly, the bars or rods can become quite sizeable, often being several inches long, resulting in filters over a foot in length. Third, printed distributed element filters have been used. Generally, they comprise a single layer of metal traces printed on an insulating substrate, with a ground plane on the back of the substrate. The traces are arranged as transmission line networks to make a filter. Again, the size of these filters can become quite large. These filters also suffer from various responses at multiples of the center frequency.

Historically, filters have been fabricated using normal, that is, non-superconducting materials. These materials have inherent lossiness, and as a result, the circuits formed from them have varying degrees of loss. For resonant circuits, the loss is particularly critical. The Q of a device is a measure of its power dissipation or lossiness. Resonant circuits fabricated from normal metals in a microstrip or stripline configuration have Qs at best on the order of four hundred. See, e.g., F. J. Winters, et al., "High Dielectric Constant Strip Line Band Pass Filters", IEEE Transactions On Microwave Theory and Techniques, Vol. 39, No. 12, December 1991, pp. 2182–87.

With the discovery of high temperature superconductivity in 1986, attempts have been made to fabricate electrical devices from high-temperature-superconductor materials.

The microwave properties of the high temperature superconductors (HTSCs) has improved substantially since their discovery. Epitaxial superconductive thin films are now routinely formed and commercially available. See, e.g., R. B. Hammond et al, "Epitaxial $Tl_2Ca_1Ba_2Cu_2O_8$ Thin Films With Low 9.6 GHz Surface Resistance at High Power and Above 77° K", Applied Physics Letters, Vol. 57, pp 825–27 (1990). Various filter structures and resonators have been formed from HTSCs. Other discrete circuits for filters in the microwave region have been described. See, e.g., S. H. Talisa, et al., "Low- and High-Temperature Superconducting Microwave filters," IEEE Transactions on Microwave Theory and Techniques, Vol. 39, No. 9, September 1991, pp. 1448–1554.

Devices with zero resistance should have an infinite Q. However, even superconductive devices are not perfectly lossless at high frequencies. However, they do have exceedingly high Qs. For example, a thallium superconductor strip line resonator at 8.45 GHz has been measured with a Q of 26,000 as compared to a Q of literally a few hundred for the best conventional metal resonator. See, e.g., F. J. Winters, et al., "High Dielectric Constant Strip Line Band Pass Filters" cited above.

Vairous filter structures have been formed utilizing significant superconductive components. See, e.g., U.S. Pat. No. 5,616,538 "STAGGERED RESONATOR ARRAY". In many applications keeping filter structures to a minimum size is very important. This is particularly true of high-temperature superconductor (HTS) filters where the available size of usable substrates is generally limited. In the case of narrow-band microstrip filters (e.g., bandwidths of the order of 2 percent, but more-especially 1 percent or less) this size problem can become quite severe. In narrow-band microstrip filters substantial differences between even- and odd- mode wave velocities exist when the substrate dielectric constant is large. This can create relatively large forward coupling between the resonators thereby presenting a need for large spacings between the resonators in order to obtain the required narrow bandwidth. See, G. L. Matthaei and G. L. Hey-Shipton, "Concerning the Use of High-Temperature Superconductivity in Planar Microwave Filters," IEEE Trans. on MTT, vol. 42, pp. 1287–1293, July 1994. This may make the overall filter structure unattractively large or, perhaps, impractical or impossible for some situations.

FIG. 1 shows a two-resonator comb-line filter 10 realized in a stripline configuration so the even- and odd-mode velocities on the coupled lines will be equal (thus, preventing forward coupling). The two resonators 11 are grounded at the sidewall 12, and in this example the input and output couplings 13 are provided by tapped-line connections. This structure would have no passband at all if it were not for the "loading" capacitors Cr 14. From the equivalent circuit for a comb-line filter it can be seen why this happens. See, G. L. Matthaei, L. Young, and E. M. T. Jones, Microwave Filters, Impedance-Matching Networks, and Coupling Structures, Artech House Books, Dedham, Mass., 1980, pp. 497–506 and 516–518.

Since the resonators are shorted at one end, when loading capacitors are zero (Cr=0) the resonators are resonant when they are a quarter-wavelength long. As seen from their open-circuited ends, they look like shunt-connected, parallel-type resonators which would yield a passband at this frequency. However, there is also an odd-mode resonance in the region between the lines which acts like a bandstop resonator connected in series between two shunt resonators. This creates a pole of attenuation at the same frequency that a passband would otherwise occur. Thus, the potential passband is totally blocked. However, if loading capacitors, Cr>0, are added at the ends of the resonators, the resonator lines are shortened in order to maintain the-same passband frequency. This shortens the length of the slot between the lines and causes the pole of attenuation to move up in frequency away from the passband.

In general, the more capacitive loading used, the further the pole of attenuation would be above the passband, and the wider the passband of the filter can be. If only small loading capacitors Cr are used, a very narrow passband can be achieved even though the resonators are physically quite close together. Similar operation also occurs if more resonators are present. If the structure in FIG. 1 is realized in a microstrip configuration, the performance is considerably altered because of the different even- and odd-mode velocities, though some of the same properties exist in modified form.

FIG. 2A shows a common form of hairpin-resonator bandpass filter 20. See, E. G. Cristal and S. Frankel, "Hairpin-Line and Hybrid Hairpin-Line/Half-Wave Parallel-Coupled-Line Filters," IEEE Trans. MTT, vol.

MTT-20, pp. 719–728, November 1972. The filter 20 can be thought of as an alternative version of the parallelcoupled-resonator filter first introduced by S. B. Cohn in "Parallel-Coupled Transmission-Line-Resonator Filters," IRE Trans. PGMTT, vol. MTT-6, pp. 223–231 (April 1958), except that here the resonators 21 are folded back on themselves. See G. L. Matthaei, L. Young, and E. M. T. Jones, Microwave Filters, Impedance-Matching Networks, and Coupling Structures, Artech House Books, Dedham, Mass., 1980, pp. 472–477). Note that in FIG. 2A the orientations of the hairpin-resonators 21 alternate (i.e. neighboring resonators face opposite directions). This results in quite strong coupling which makes this structure capable of considerable bandwidth. However, in the case of narrow-band filters, particularly for microstrip filters on a high-dielectric substrate, this structure is undesirable as it may require quite large spacings between the resonators 21 to achieve a desired narrow bandwidth.

FIG. 2B shows another common form of hairpin-resonator filter 22. See, M. Sagawa, K. Takahashi, and M. Makimoto, "Miniaturized Hairpin Resonator Filters and Their Application to Receiver Front-End MIC's," IEEE Trans. MTT, vol. 37, pp. 1991–1997 (December 1989). In this case the open-circuited ends 23 of the resonators 24 are considerably foreshortened and a strongly capacitive gap 25 is added to bring the remaining structure into resonance. The resonators are then semilumped, the lower part 26 being inductive and the upper part 27 being capacitive. The coupling between resonators 24 is almost entirely inductive, and it makes little difference whether adjacent resonators are inverted with respect to each other or not. Hence, as is shown in FIG. 2B, these resonators are usually made to have the same orientation (i.e. neighboring resonators face the same direction). If the resonators have sufficiently large capacitive loading these resonator structures can be quite small, but, typically, their Q is inferior to that of a full hairpin resonator. Also, there will normally be no resonance effect in the region between the resonators so that the coupling mechanism cannot be used to generate poles of attenuation beside the passband in order to enhance the stopband attenuation.

Therefore, the need for compact, reliable, and efficient narrow-band filters with very high Q resonator which can be manufactured with consistency remains unsatisfied. Despite the clear desirability of improved electrical circuits, including the known desirability of converting circuitry to include superconducting elements, room remains for improvement in devising alternate structures for filters. It has proved to be especially difficult to substitute high temperature superconducting materials in conventional circuits to form superconducting circuits without severely degrading the intrinsic Q of the superconducting films. Among the problems encountered are radiative losses and tuning, which remain despite the clear desirability of improved filters. As is described above, size has remained a concern, especially for narrow-band filters. Also, power limitations arise in certain structures. Despite the clear desirability for forming microwave filters for narrow-band applications, to permit efficient use of the frequency spectrum, a need remains for improved designs capable of achieving those results in an efficient and cost effective manner.

SUMMARY OF THE INVENTION

The microwave filters of the present invention provide compact, reliable, and efficient (i.e. low-loss, e.g., HTS resonators capable of Qs higher than conventional metal resonators. narrow-band (i.e. capable of band widths on the order of 2% but more especially 1% or less filters which can be manufactured with consistency as are now frequently needed for critical wireless communication applications and other applications. These microwave filters when made from high temperature superconducting films in a hairpin-comb configuration are particularly suited to resolve the problems found with prior filters.

As is described above, it is desirable to use high Q, nominally half-wavelength resonators in as compact a configuration as is possible to avoid the space problems described above. The hairpin-comb filters the present invention provide a way around the space problem described above. The use of hairpin resonators has the benefit of reducing the size of a filter since the folded half-wavelength resonators are somewhat less than a quarter wavelength long. The structure of the present invention preferably does not include ground connections as they are not necessary because opposite sides of a hairpin resonator have opposite potentials thereby resulting in a virtual ground running down the center line of symmetry of the resonator. This structure may preferably include an optional capacitor in the coupling region between resonators to help adjust the bandwidth of the filter and to add additional control over the location of the adjacent pole(s) of attenuation. In addition, the structure of these filters can be made extremely narrow-band even though the resonators are very close together.

Therefore, it is a primary object of the present invention to provide a narrow-band microwave filter having high Q half-wavelength hairpin resonators in a comb configuration which is more compact than prior filters.

It is a further object of the present invention to provide a narrow-band microwave filter in a hairpin-comb configuration.

It is also an object of the present invention to provide a narrow-band microwave filter made from high temperature superconducting materials.

Other objects and features of the present invention will become apparent from consideration of the following description taken in conjunction with the accompanying drawings.

DETAILED DESCRIPTION OF THE PREFERRED EMBODIMENTS

As is described above, the present inventors has discovered that narrow-band microwave filters in hairpin-comb configurations are particularly suited to resolve important problems found with prior narrow-band filters. Particularly, the hairpin-comb filters of the present invention provide compact, reliable, and efficient (i.e. low-loss) narrow-band filters with high-Q nominally half-wavelength resonators which require no ground connections and which can be manufactured with consistency. In addition, the hairpin-comb filters of the present design are particularly suited to be manufactured from high temperature superconducting films.

Figure 1:
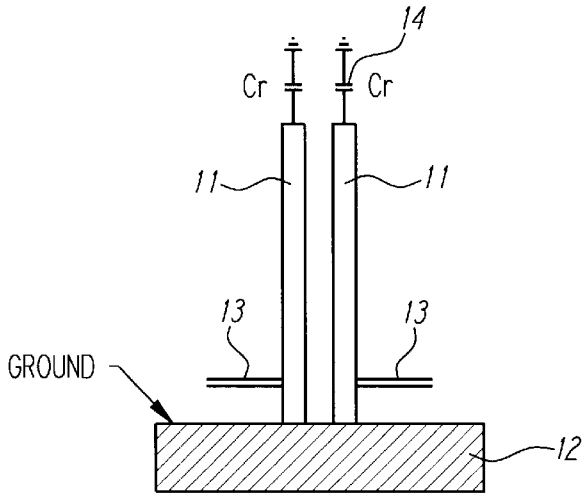
FIG. 1 (PRIOR ART)
FIG. 1 shows a known two-resonator stripline comb-line filter with tapped-line couplings at the input and output.
Figure 3:
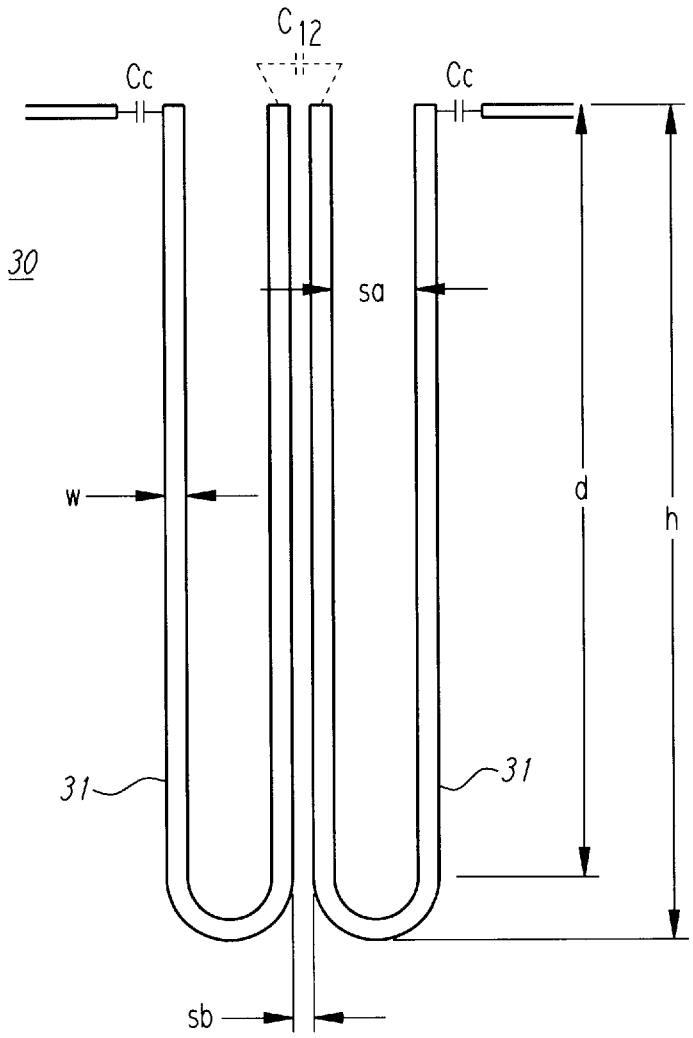
FIG. 3 shows a two-resonator hairpin comb filter of the present invention.
Figure 13:
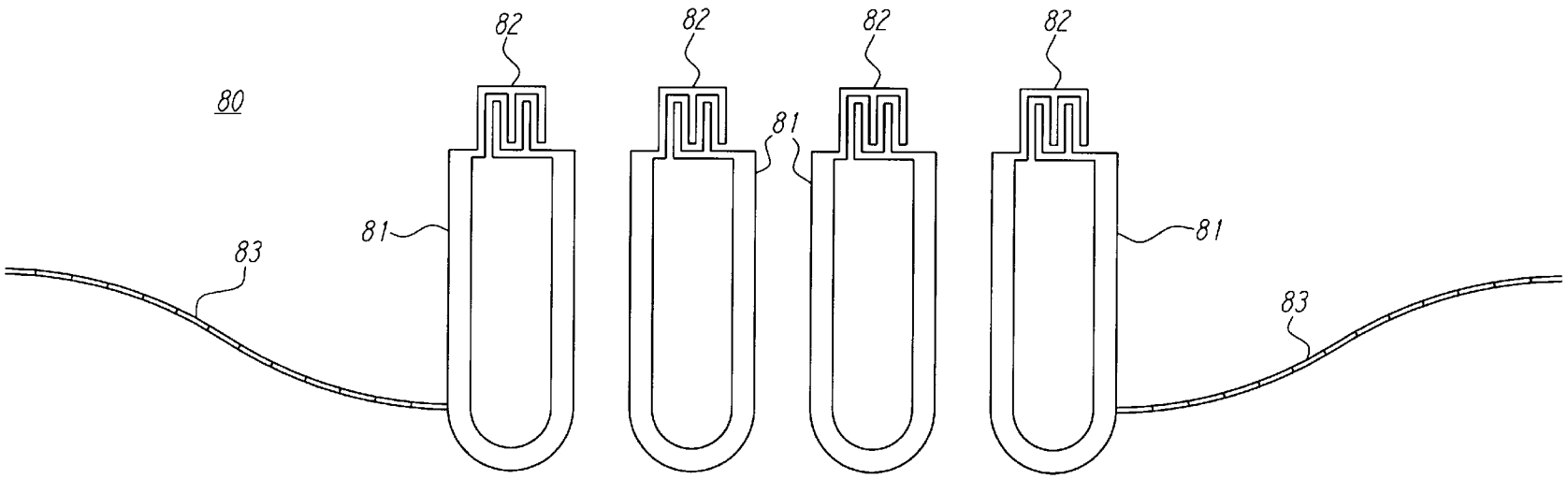
FIG. 13 shows a four-resonator hairpin-comb filter of the present invention with a tapped line and, a tapped line out put.

FIG. 3 shows a "hairpin-comb" filter 30 of the type of the present invention. A two-resonator hairpin-comb filter with capacitance couplings at the input and output are shown in FIG. 3. In FIG. 3, series-capacitance input and output couplings are shown, although tapped-line couplings as shown in FIGS. 1 and 13 could be used. The resonator lines 31 are roughly a half-wavelength long, and are folded back on themselves so the height h of the resonators 31 is just less than a quarter wavelength.

Unlike the comb-line filter in FIG. 1, the structure in FIG. 3 has no ground connections. However, since the opposite sides of a hairpin resonator have opposite potentials, there is a virtual ground running through the center line of symmetry of the resonator 31. Thus, the filter 30 in FIG. 3 is expected to have properties similar to those of a comb-line filter 10 shown in FIG. 1. However, even though the hairpin-comb filter 30 does have similarities to a comb-line filter 10, the behavior of the hairpin-comb filter 30 is more complex.

In a stripline hairpin-comb structure of the present invention as shown in FIG. 3, when the capacitance of the optional capacitor C12 is zero and there are equal even- and odd-mode velocities, a pole of attenuation is created at the frequency for which the parallel-coupled region d is a quarter-wavelength long (assuming any couplings beyond nearest-neighbor lines are negligible). The capacitance of the optional capacitor C12 in FIG. 3 can be increased to greater than zero to add control over the location of the adjacent pole of attenuation (or of multiple poles of attenuation in structures with more resonators) and also to help adjust the bandwidth of the filter 30. The filter structure 30 in FIG. 3 can be thereby made to be extremely narrow-band even though the resonators 31 may be very close together. As is the case when comparing hairpin-comb filters to comb-line filters, microstrip hairpin-comb filters have many similar properties to, but are more complicated to analyze and design than, microstrip comb-line filters (but are much easier to fabricate since no ground connections are required).

As is described above, FIG. 2A shows a well known form of hairpin-resonator bandpass filter 20. The hairpin-comb type of filter as in FIG. 3 differs from the hairpin filter in FIG. 2A primarily in that the orientation of the resonators in a hairpin-comb filter is always the same. This difference is important. Resonances that occur in the coupling regions, sb in FIG. 3, between resonators greatly reduce the coupling between resonators, and with the addition of a small capacitance C12 between resonators as is shown in FIG. 3, it is, for an extreme example, possible to eliminate the passband entirely even though the resonators are quite closely spaced preferably on the order of substantially sa or less. The hair-pin filter of FIG. 2A has very strong coupling between resonators and that coupling cannot be reduced by adding capacitance between resonators. Hence, narrow-band hair-pin filters of conventional form need very large spacings between resonators in order to achieve very narrow bandwidths.

As is also described above, FIG. 2B shows another common form of hairpin-resonator filter 22. The hairpin-comb type of filter as in FIG. 3 might at first be thought to be fundamentally the same as the hairpin-comb filter in FIG. 2B, whereas, actually, it is quite different. As is described above, the open-circuited ends 23 of the resonators 24 shown in FIG. 2B are considerably foreshortened and a strongly capacitive gap 25 is added to bring the remaining structure into resonance. The resonators formed in this manner are miniaturized and are semi-lumped, the lower part 26 being inductive and the upper part 27 being capacitive. The coupling between resonators 24 is almost entirely inductive, and no resonance effect occurs in the coupling region between resonators and no poles of attenuation are created adjacent to the passband. Thus, this mechanism is not available for narrowing the bandwidth of the filter or enhancing the attenuation adjacent to the passband. If the loading capacitance can be made to be quite large the length of the vertical sides of the resonator may be reduced sufficiently to decrease mutual inductance so moderate spacings between resonators may be possible. However, such heavily loaded resonators typically have the disadvantages of reduced Q as well as no facility for introducing poles of attenuation.

Figure 2A:
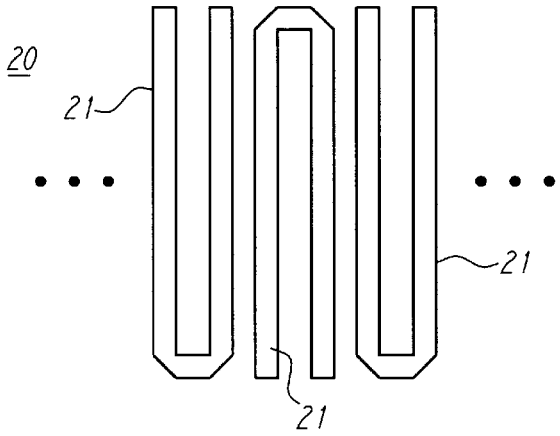
FIG. 2A (PRIOR ART)
FIG. 2A shows a known common form of hairpin-resonator filter structure.
Figure 2B:
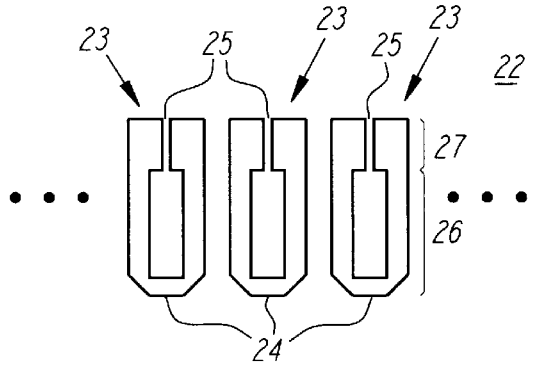
FIG. 2B (PRIOR ART)
FIG. 2B shows a known common form of loaded hairpin-resonator filter structure.

In comparing FIGS. 2A, 2B, and 3, it can be seen that the hairpin-comb type of filter of FIG. 3 differs from the hairpin filter structures in FIGS. 2A and 2B in that the hairpin resonators all have the same orientation while the coupling regions between resonators are sufficiently long so as to involve resonance effects which can greatly reduce the coupling between resonators at frequencies in the range of the desired passband. In FIG. 3, the length d is between ⅛ wavelength and a value approaching ¼ wavelength at the frequency of resonance in the media of the transmission line. In addition, the hairpin-comb structure in FIG. 3 uses rounded sections at the bottoms of the resonators, rather than rectangular sections as in FIGS. 2A and 2B. This is not fundamental to this type of filter, but the round sections have the added benefit of preventing regions with unnecessarily high current density which can cause nonlinear effects in a superconductor.

Some specific embodiments of the narrow-band microstrip hairpin-comb filters of the present invention will be addressed below.

In narrow-band microstrip hairpin-comb filters of the present invention the couplings beyond nearest neighbor resonators is much more important than it would be in relatively wide-band hairpin filter structures as in FIGS. 2A and 2B. This is because for a hairpin-comb filter the direct coupling between adjacent resonators is relatively small so that the stray couplings beyond nearest neighbor line sections becomes much more important and there may be significant coupling beyond nearest neighbor lines in the microstrip case. In order to obtain accurate microstrip designs it is important to include couplings beyond nearest neighbors lines. This makes use of the more common design procedures based on network synthesis techniques impractical. As a result, we used what might be called "educated cut and try" technique to obtain the desired responses. We used an in-house CAD program which handles multiple lines using the "method of lines" (MoL) technique. See, R. Pregla and W. Pascher, "The Method of Lines," Numerical Techniques for Microwave and Millimeter-Wave Passive Structures, T. Itoh, Editor, Wiley, New York (1989). The program will also treat single or multiple curved line sections using the methods described by H. Diestel, "A Quasi-TEM Analysis for Curved and Straight Planar Multiconductor Systems," IEEE Trans. MIT, vol. 37, pp. 748–753 (April 1989). This program obtains the quasistatic capacitance and inductance matrices for multiple lines and uses the data for computing frequency responses. Structures like the semi-lumped capacitors were designed with the aid of the planar full-wave analysis program EM. EM is a full-wave field solver for planar circuits and is produced by Sonnet Software, Suite 100, 101 Old Cove Road, Liverpool, N.Y. 13090.

A two resonator microstrip filter as in FIG. 3 was designed using a $LaAlO_3$ substrate h=0.267 mm thick having $\xi_r$=24.1. The dimensions, of the designed filter as shown in FIG. 3, were d=8.504 mm, sa=1.0 mm, w=0.30 mm, and sb=0.20 mm where d is the length of the parallel coupled region, as is the spacing between parallel coupled resonator lines, w is the width of each resonator line, and sb is the spacing between resonators. The coupling capacitance Cc was about 0.216 pf, though a pi equivalent circuit for the coupling capacitor was actually used for analysis purposes. Accurate analysis of the coupling capacitor C12 as designed was troublesome because the two ports for the capacitor were on the same plane and close together and interacted. In addition, the capacitor finger structure was not symmetrical as viewed from these ports. If the finger structure had been symmetrical as seen from the ports a more accurate analysis could have been obtained using even- and odd-mode excitation. A final value for C12 (0.076 pf) for use in computing the theoretical response was obtained by varying the value of C12 used in the program until the computed frequency of the pole of attenuation below the passband closely agreed with the measured frequency for that pole (1.865 GHz). Then the computed passband width at points 1-dB-down from the minimum attenuation was Δf=14.8 MHz and the passband center frequency was computed to be $f_o$=1.97 GHz. This compares with measured values of Δf=14.2 MHz and $f_o$=1.955 GHz. This is an approximately 0.73 percent bandwidth.

Figure 4:
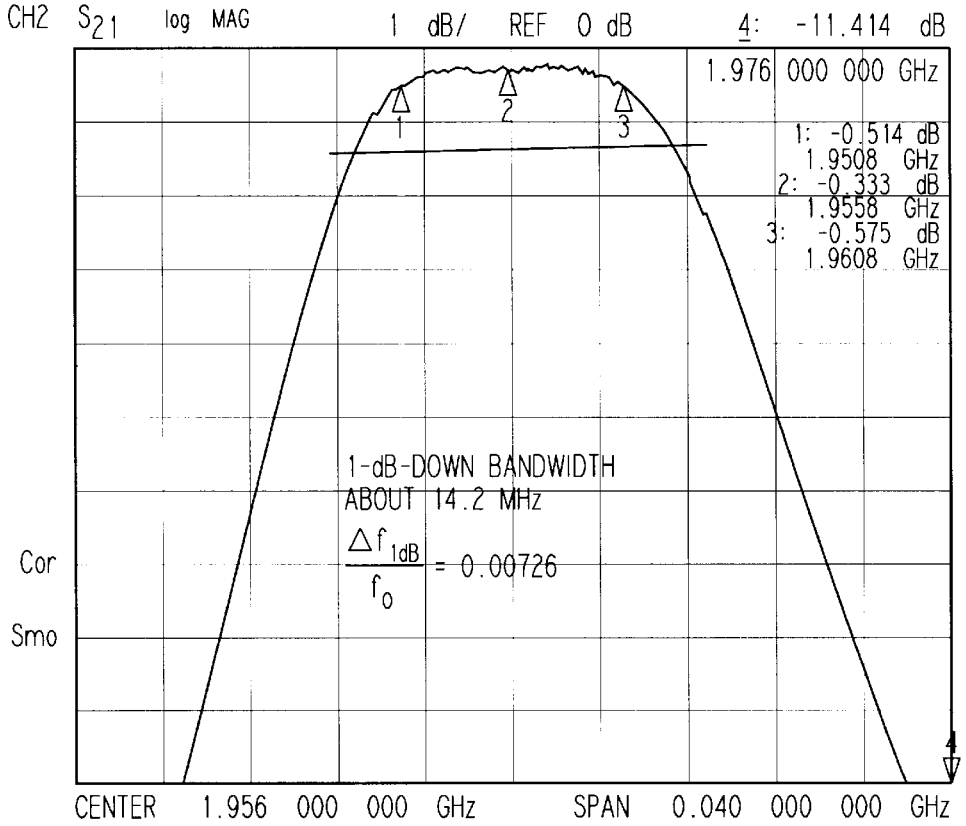
FIG. 4 shows a measured response for a trial microstrip two-resonator hairpin-comb filter of the present invention.
Figure 5:
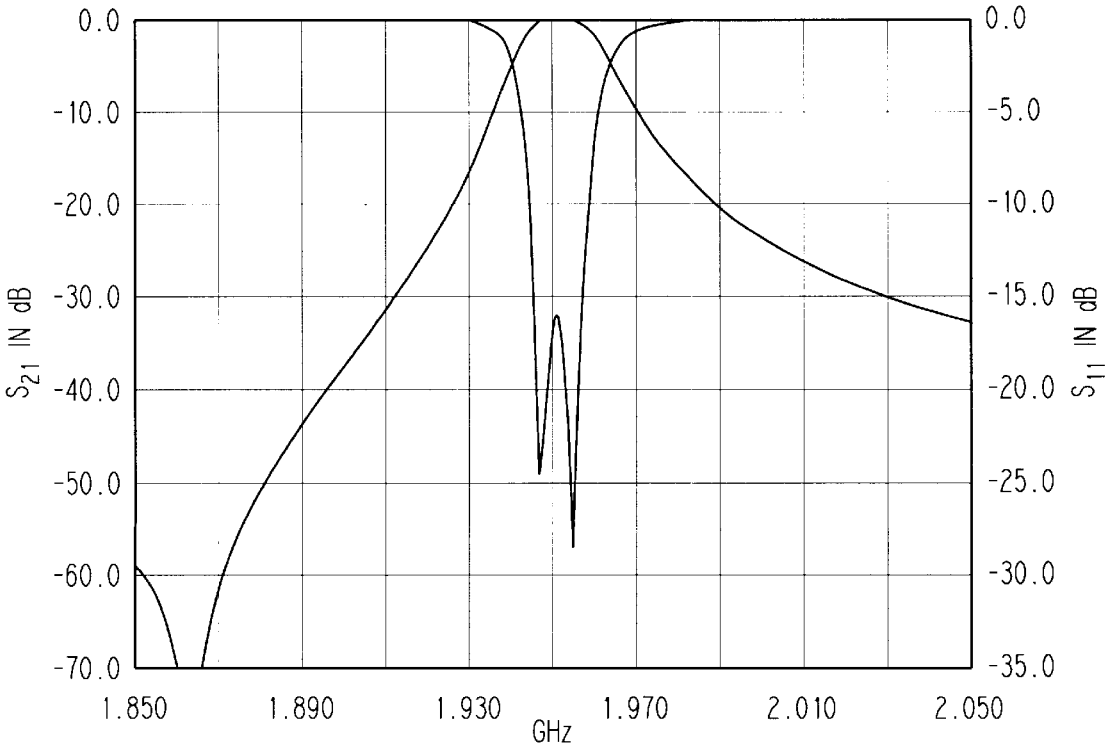
FIG. 5 shows a broad-range computed response for a trial micro trip two-resonator hairpin-comb filter of the present invention.

FIG. 4 shows the measured passband response of this filter while FIG. 5 is a computed response showing the nature of the response of this type of two-resonator filter on a more broad-range basis. The measured minimum loss in the passband was approximately 0.33 dB including the loss of the normal metal connectors. Most of this passband loss is believed to be due to the losses of the normal metal connectors and connecting lines.

With regard to the pole of attenuation as shown in FIG. 5, it is interesting to note that with C12=0, for a stripline design the pole will occur above the passband while for the microstrip designs we have tried it occurs below the passband. At least for the microstrip case, adding C12 causes the pole to move up in frequency (rather than down as, at first, might be expected).

For the filter shown in FIG. 3 with C12=0 the computed location of the pole was 1.698 GHz while for C12=0.076 pf the pole moved up to 1.865 GHz. Computed responses show that for the microstrip case if we continue to increase the size of C12 that the pole will move up in frequency into the upper side of the passband. This provides means to enhance the attenuation characteristics on both sides of the passband in filters with, for example, four or more resonators. This could be done by designing some coupling gaps and capacitors in the filter to give poles of attenuation on one side of the passband and other coupling gaps and capacitors in the same filter to give poles of attenuation on the other side of the passband. This may be a quite useful technique. As is discussed below, there is another way of accomplishing the same result.

Figure 6:
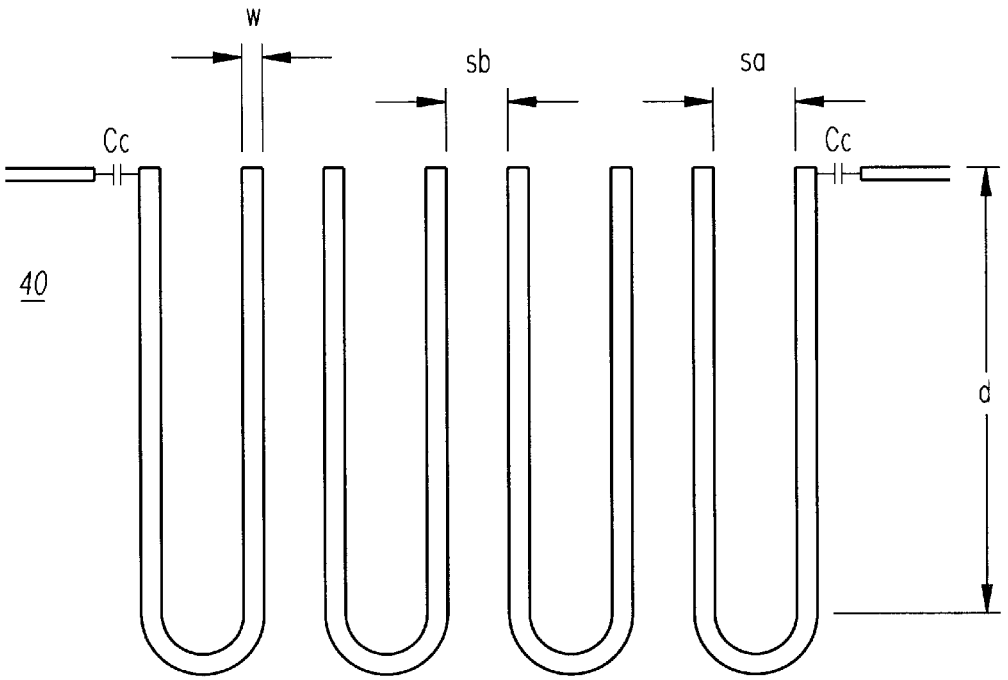
FIG. 6 shows a four-resonator hairpin-comb filter of the print invention.

A four-resonator trial microstrip hairpin-comb filter 40 including coupling capocitances Cc as shown in FIG. 6 was also designed, fabricated, and tested. Using the same dimension definitions as shown in FIG. 3, the filter 40 shown in FIG. 6 was designed and fabricated with d=8.626 mm, sa=1.5 mm, w=0.5 mm, and the spacing between the resonators at the center of the filter, sb, was 1.45 mm. The substrate was 0.283 mm thick $LaAlO_3$. Some minor modifications of the upper ends of the end resonators was needed to obtain synchronous tuning. Also, slight tuning of the two inner resonators was accomplished by insertion of dielectric material near the resonators.

Figure 7A:
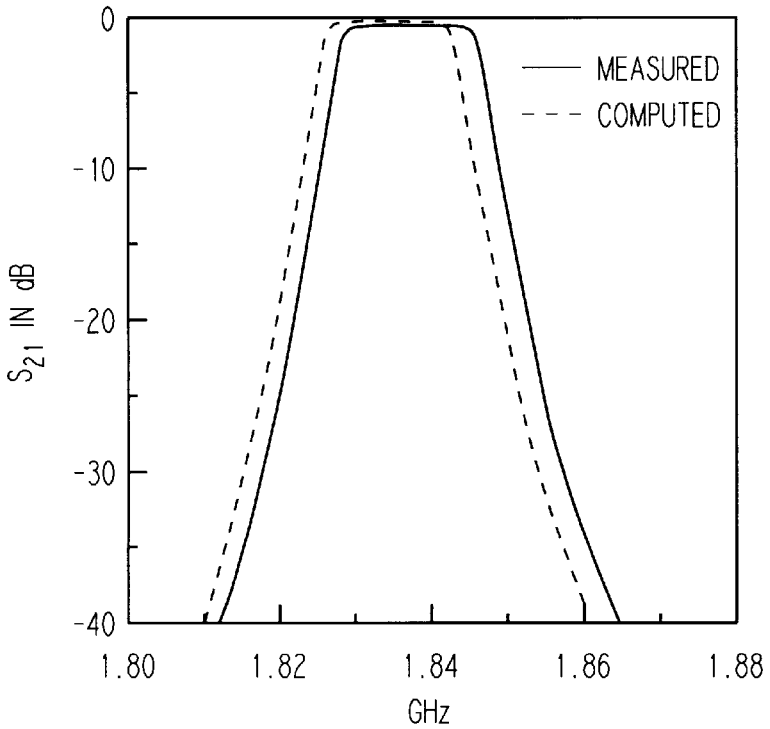
FIG. 7A shows computed and measured transmission response trial microstrip four-resonator hairpin-comb filter of the present invention.
Figure 7B:
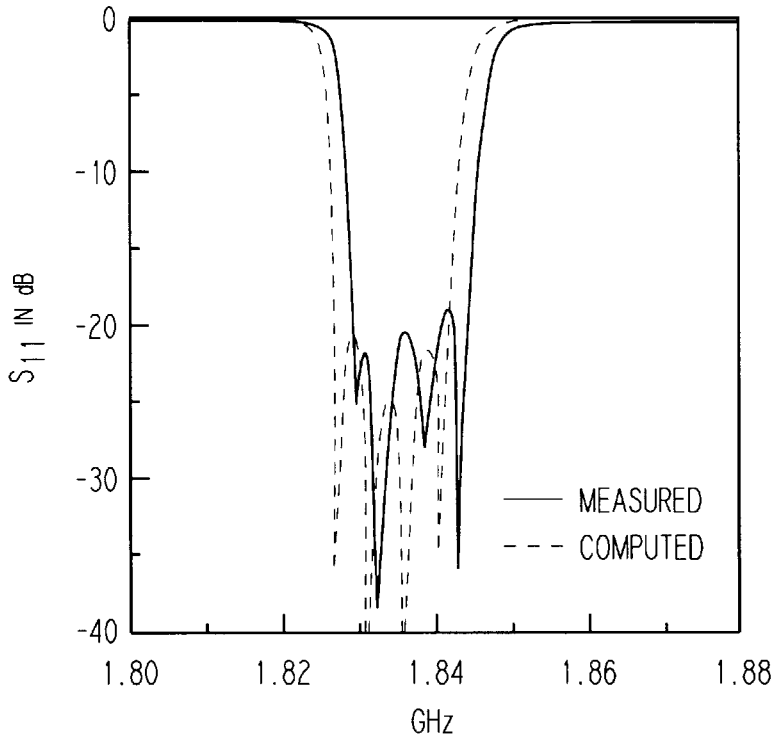
FIG. 7B shows computed and measured return losses for a trial microstrip four-resonator hairpin-comb filter of the sent invention.
Figure 8:
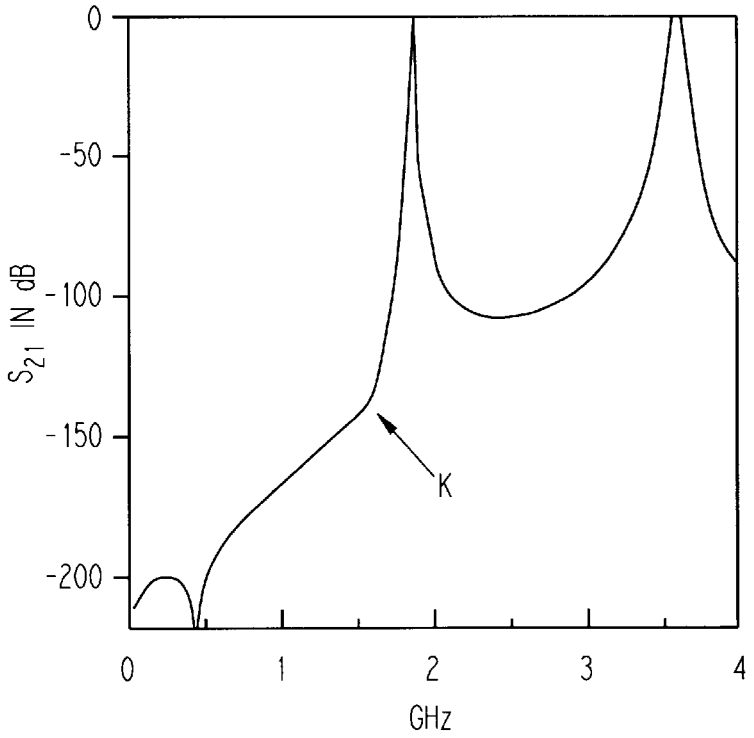
FIG. 8 shows broad-range computed response for a trial microstrip four-resonator hairpin-comb filter of the present intention.

FIG. 7A shows the measured and computed transmission response of the filter of FIG. 6 while FIG. 7B shows the measured and computed return loss. The passband width at points 1-dB-down from the minimum loss point was 17.2 MHz, and the measured passband was centered at 1.8360 GHz. The percentage bandwidth was 0.94. The minimum passband loss was approximately 0.41 dB including the loss of the normal metal connectors. FIG. 8 presents a computed response which shows the predicted response for the filter of FIG. 6 over a wide range of frequencies and attenuation. It is of interest to note that the pole of attenuation at about 0.4

GHz is also observed in the computed response of the center two resonators in this structure taken by themselves. Thus, this pole appears to be associated with the coupling gaps between resonators. However, as is shown in FIG. 8, a knee K appears i attenuation characteristic at about 1.7 GHz. This is indicative of poles of attenuation nearby (somewhat off of the jω axis of the complex frequency plane). These poles are also believed to be due to coupling beyond nearest neighbor lines along with the coupling regions between resonators.

Figure 9A:
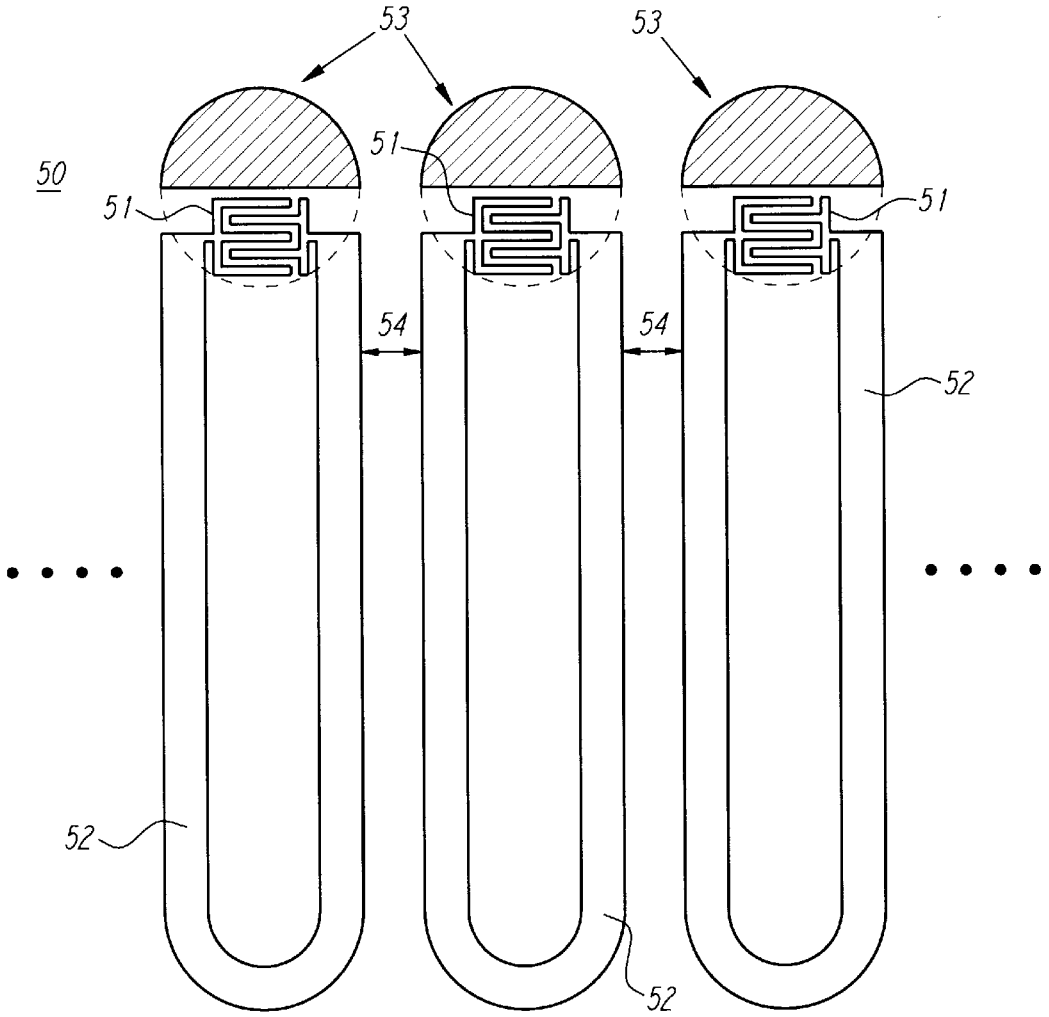
FIG. 9A shows other hairpin-comb filter structure of the present invention including a tuning structure.

For the purposes of practical design and manufacture of narrow-band filters it is very important to have means for adjusting (i.e., tuning) the resonant frequency of the resonators so as to be precisely at the required center frequency. FIG. 9A shows a modified form of microstrip hairpin-comb filter 50 which provides very effective tuning, particularly for HTS filters where the use of normal metal tuning screws must be avoided. As an example, an interdigital capacitor 51 (or other two conductor structure is placed between the open ends of each resonator 52. The fields about the interdigital fingers of the capacitors 51 are in dielectric below the substrate surface and in air above the substrate surface. A rotating, half-round dielectric tuner 53 is mounted near each capacitor 51, as is shown in FIG. 9A. When the tuners 53 are rotated to overlap/cover at least a portion of the interdigital capacitors, they will cause the fields above the interdigital fingers of the capacitors 51 to also be in dielectric (i.e. the dielectric of the tuner 53), thus increasing the amount of capacitance of the capacitor 51. This will result in the resonant frequency of the resonators 52 being lowered, thus providing means for tuning. Note that in FIG. 9A the dielectric tuners 53 are kept well away from the coupling gaps 54 between the resonators 52 so that the tuners 53 will have negligible effect on the coupling between resonators 52.

The structure in FIG. 9A may seem similar to that shown in FIG. 2B in that in both cases capacitance is added across the open ends of the resonators (52 in FIG. 9A and 23 in FIG. 2B respectively). However, the objectives and the amount of capacitive loading in the case of the structure shown in FIG. 9A are much different than for the case of that shown in FIG. 2B. In the case of the structure shown in FIG. 2B quite a large amount of capacitance is added between the open ends of the resonators 23 along with a considerable amount of added shunt capacitance to the ground plane below each resonator 23. This is done for the purpose of being able to reduce the line length of the resonators considerably. However, in the case of the structure shown in FIG. 9A we wish to add only enough bridging capacitance between the open ends of each resonator 52 to provide an adequate tuning range (say, a shift in frequency of perhaps about 1 percent), and we wish to introduce as little as possible additional capacitance to ground.

If the interdigital capacitors 51 of the structure shown in FIG. 9A are made to be excessively large, this will require a reduction in the line length of the resonators 52 and may make the desired weak coupling between closely spaced resonators more difficult to achieve. For example, if the line length of the resonators 52 is reduced, there will be an attendant reduction in the vertical length of the coupling regions between resonators 52. This would, in turn, require that the resonators 52 be separated more and the overall size of the filter 50 increased if the same bandwidth is to be maintained.

The tuning capacitors shown in FIG. 9A are unusually effective. This is because they have virtual grounds running through their centerlines. As a result, it is easily shown that tuning capacitors having a capacitance of C can be modeled by capacitors having a capacitance of 2 C located at the open ends of each resonator and connected to ground. Thus it can be seen that a tuning capacitor in the configuration shown in FIG. 9A is four times as effective for tuning as would be a single capacitor having a capacitance of C connected between one end of a half-wavelength resonator and ground, as is commonly used for tuning. The hairpin-comb type of filter of the present invention lends itself very well to this attractive form of tuning. This is particularly fortuitous since hairpin-comb filters are most useful for narrow-band filter applications, and it is for those applications that having good provision for tuning is most important.

Figure 9B:
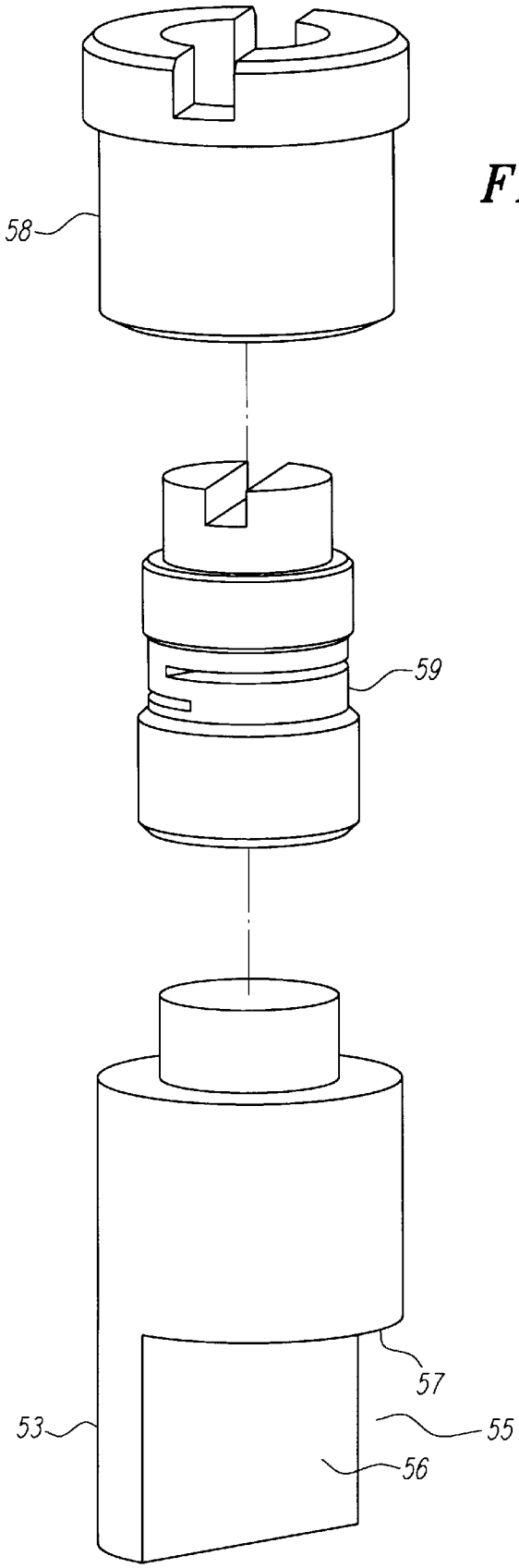
FIG. 9B shows an exploded, perspective view of a tuning structure for use, for example, in FIG. 9A.
Figure 9C:
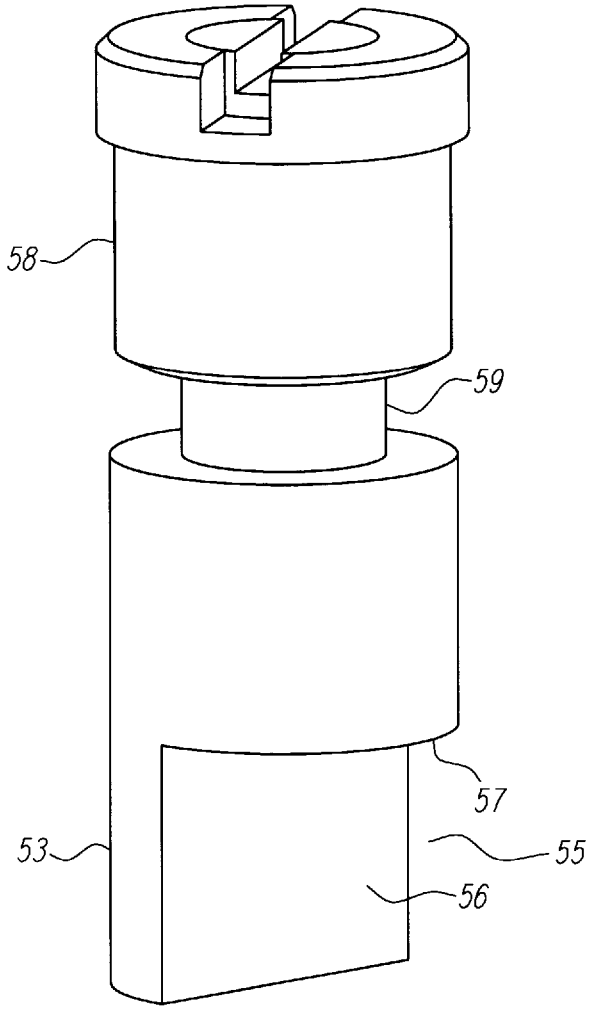
FIG. 9C shows a perspective view of a tuning structure for use, for example, in the structure of FIG. 9A.

FIG. 9B shows an exploded view of a preferred rotatable dielectric tuning mechanism advantageously used, for example, in connection with FIG. 9A. FIG. 9A shows dielectric portions 53 from a top down view in what would be viewing FIG. 9B and 9C from the top of the figure towards the bottom. The dielectric member 53 preferably includes a recessed portion 55 which is shown in FIG. 9A by the dashed lines, and in FIGS. 9B and 9C by the recessed portion defined, preferably, by a face 56 and overhang portion 57. In operation, the bottom semicircular face of the dielectric 53 is brought into contact or proximity with the underlying electrical structure. Preferably, a sheet, such as a mylar sheet, covers the surface of the circuit substrate for protection. A bushing 58 with an optional slot for rotation co-acts with a metal rotor 59, preferably brass, with a machined surface of rotor 59 positioned against the bore in the bushing 58. For example, in operation, threading the bushing further compresses the slots in the rotor 59 to create a contact force of the dielectric 53 against the electrical device or optional overlying sheet. Preferably, the dielectric rotor assembly possesses full rotational freedom for tuning.

Figure 10:
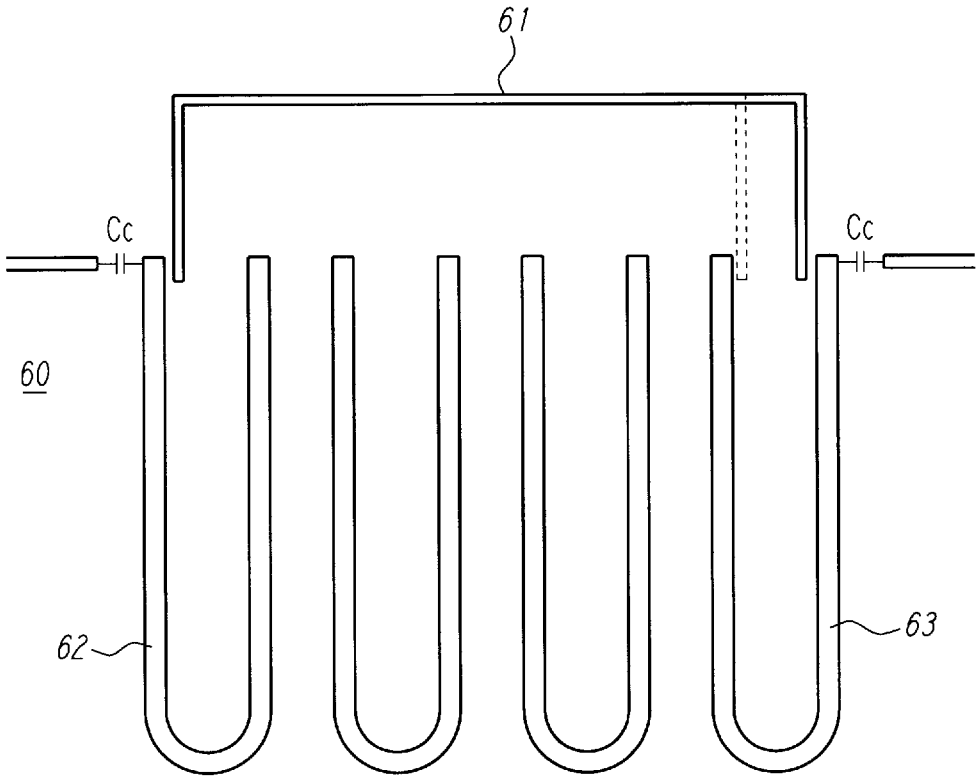
FIG. 10 shows yet another hairpin-comb filter structure of present invention.
Figure 11:
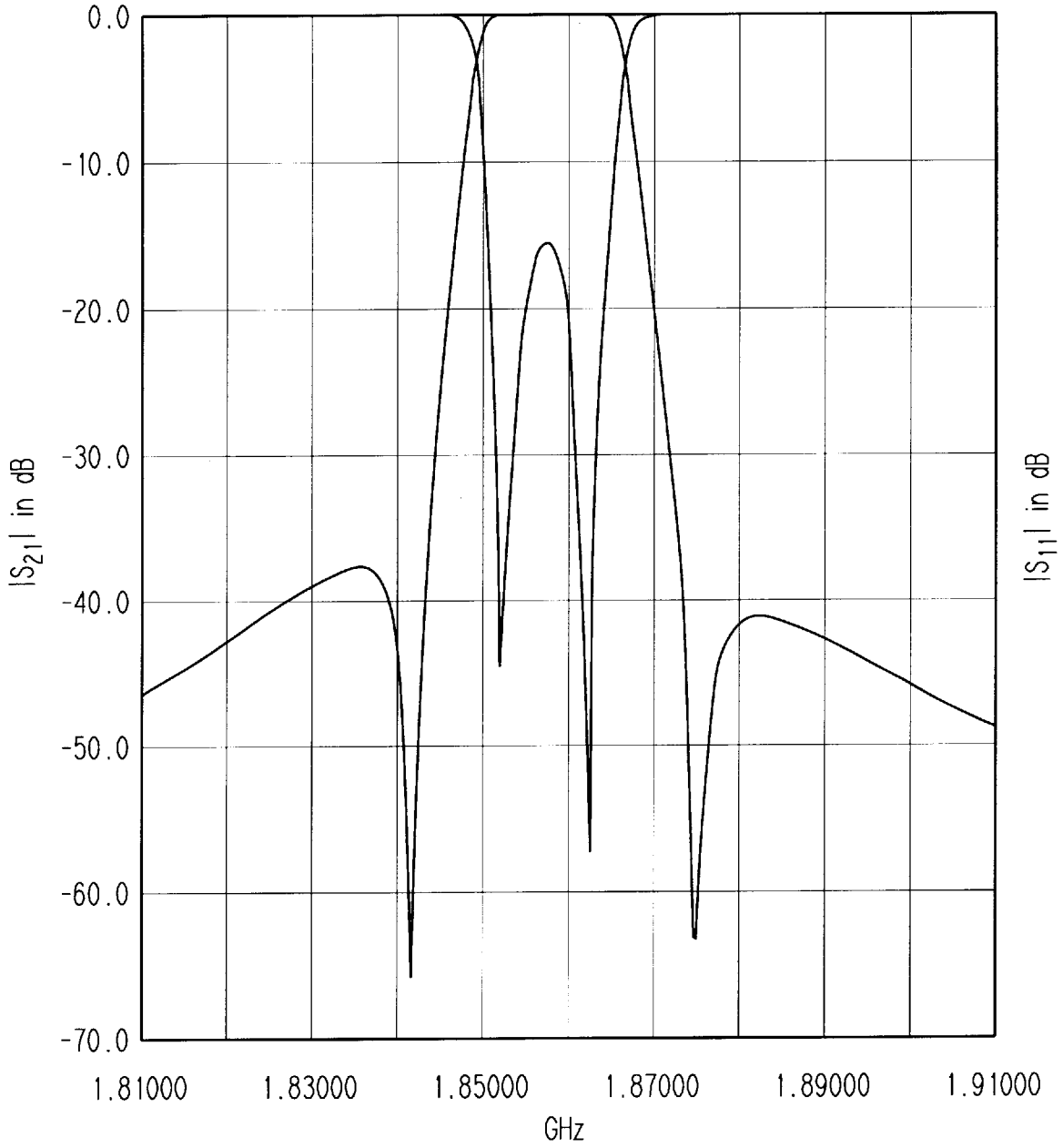
FIG. 11 shows a computed response for the hairpin-comb filter structure shown in FIG. 10.

It is well known that by inclusion of coupling beyond nearest neighbor resonators poles of attenuation can be introduced near the edges of the passband of a filter, or if the couplings have the opposite phase, they can be used to make the time delay characteristics of a filter more nearly constant. Keeping these principles in mind, FIG. 11 shows a computed response for the filter structure 40 shown in FIG. 6 (responses shown in FIGS. 7A and 7B) with capacitive coupling added between the first and fourth resonators. As is shown in FIG. 11, poles of attenuation have been added at both sides of the passband. The passband response has also been degraded, but this could be corrected by some adjustment of the filter couplings. FIG. 10 shows an embodiment of a filter 60 implementing this filter technique in a practical way. Note the line 61 (shown in solid line) between the first resonator 62 and fourth resonator 63 resonators with capacitive coupling to the resonators 62 and 63.

The hairpin-comb type of filter, an example of which is shown in FIG. 10, as including coupling capacitance Cc is particularly convenient for this technique because the desired choice of phase for the coupling can easily be established by the choice of resonator connection. For example, if it was desired to flatten the time delay characteristic of filter 60 shown in FIG. 10, rather than generate poles of attenuation beside its passband the designer would get the desired phase by coupling the right end of the coupling line 61 to the left side of the fourth resonator 63 as is shown in dashed lines (as compared to coupling to the right side of the fourth resonator 63 as is shown in solid lines). In the case of a filter with more resonators, multiple couplings between non-adjacent resonators using this technique should be easily accomplished. It appears that the implementation of filters with couplings beyond nearest neighbors should be unusually convenient for the case of hairpin-comb filters which should permit very general and efficient filter designs.

Figure 12:
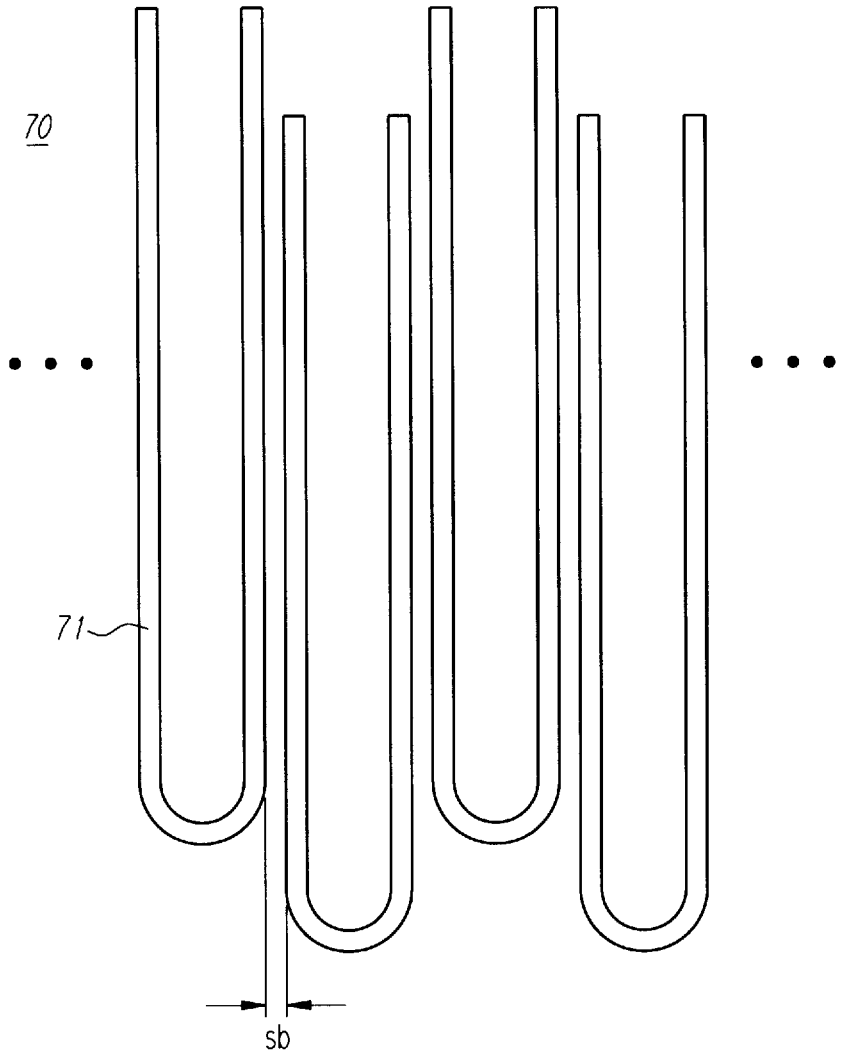
FIG. 12 shows still another hairpin-comb filter structure of t present invention.

In the case of a filter with a sizable number of resonators one might wish to use hairpin resonators with a very narrow width such as the resonators 31 shown in FIG. 3 or perhaps even narrower to help minimize the size of the filter. Using such narrow resonators, however, will make the coupling region d (see FIG. 3) relatively long which for a microstrip resonator would make the poles of attenuation below the passband quite close to the passband. This would tend to make the response rather asymmetric with a sharper cutoff on the low side. If a relatively constant time delay were required this asymmetry might be objectionable, and it might be desirable to reduce the length of the coupling region d to move these poles farther away. This could be accomplished by increasing the distance sa (see FIG. 3) to make the resonators wider again so the coupling region d is smaller, or it can be done without making the resonators wider if the resonators positions were staggered as is shown in FIG. 12. In either case making the coupling region d smaller would tend to increase the coupling so that the spacing sb between resonators would have to be increased somewhat in order to maintain the same bandwidth. However, for a given spacing sb a staggered structure 70 as shown in FIG. 12 may permit obtaining the desired bandwidth with narrower resonators 71.

It appears that the use of a stagger structure 70 of the resonators 71 as shown in FIG. 12 provides another degree of freedom which may be useful for obtaining efficient designs of minimum size. The staggering of resonators has previously been found to be useful for obtaining compact stripline filter designs. See, G. L. Matthaei and G. L. Hey-Shipton, "Novel, Staggered Resonator Array Superconducting 2.3-GHz Bandpass Filters," IEEE Trans. MTT, vol. 41, pp. 2345–2352 (December 1993).

FIG. 13 shows another example of a hairpin-comb type filter 80 of the present invention. As is shown in FIG. 13, the filter 80 includes resonators 81 which have interdigitated capacitors 82 between the open ends of each resonator 81. While the filter 80 is shown in FIG. 13 as having inductive tap connections 83 at the ends of the input and output of the filter 80, capacitance couplings, as shown, for example, in FIG. 3, could also be used.

As is described in detail above, the hairpin-comb type of filter of the present invention holds promise for the fabrication of compact, low, loss, very narrow-band filters. This can be useful for planar filters designed using normal metal conductors, but may be particularly helpful for filters fabricated from or including high temperature superconducting materials. It can be shown that this general type of structure is potentially useful for either stripline or microstrip realizations, though the designs will come out rather different for given design specifications. It appears that microstrip realizations will be of the most practical interest.

While embodiments of the present invention have been shown and described, various modifications may be made without departing from the scope of the present invention, and all such modifications and equivalents are intended to be covered.

I claim:

1. A narrow band bandpass microwave hairpin-comb filter having a microstrip configuration comprising:

a plurality of microstrip side coupled resonators, each resonator being nominally a half wavelength long at the resonant frequency in the medium of the microstrip line and each resonator comprising a hairpin configuration having an open end and a closed end, an input coupling to a first one of said plurality of resonators, an output coupling to a last one of said plurality of resonators, wherein said filter is characterized in that the plurality of microstrip resonators are oriented with the open ends thereof in a common direction thereby providing a comb configuration and defining a respective side coupling region between neighboring resonators, and the respective side coupling region having a length from between substantially ⅛ wavelength to a value approaching ¼ wavelength at the resonance frequency of the resonators, and a respective tuning capacitor across the open end of at least one of the resonators wherein the respective tuning capacitor comprises a two conductor electrode pattern on a substrate surface and a corresponding capacitance which is varied by moving a respective dielectric tuner in a plane parallel to the surface so as to overlap the corresponding electrode pattern.

2. The filter of claim 1 wherein the tuner further comprises a dielectric layer between a surface of the electrode pattern and the dielectric tuner.

3. A method of forming the filter of claim 1 comprising the step of forming the resonators from a high temperature superconductor.

4. The filter of claim 1 wherein the respective tuning capacitor comprises a respective interdigitated electrode pattern.

5. The filter of claim 1 wherein the respective dielectric tuner is rotatable about an axis normal to a surface of the corresponding electrode pattern.

6. The filter of claim 5 wherein the respective dielectric turner comprises a semi-circular shape in cross-section parallel to the surface of the substrate.

7. The filter of claim 1 having a transmission characteristic and further comprising a coupling line, the coupling line having a first end thereof and a second end thereof, wherein the first end thereof is capacitively coupled to a first resonator of said plurality of resonators and the second end thereof is capacitively coupled to a second resonator of said plurality of resonators, wherein at least one third resonator of said plurality of resonators is positioned between the first resonator and the second resonator and wherein the respective coupling modifies the transmission characteristic of the filter.

8. The filter of claim 7 having a passband and a time delay characteristic and wherein the transmission characteristic which is modified is at least one of flattening the time delay characteristic of the filter and adding at least one pole of attenuation beside the passband.

9. The filter of claim 1 wherein the respective dielectric tuner slides parallel to the corresponding electrode pattern to overlap with a portion of the corresponding electrode pattern to thereby vary the capacitance of the respective tuning capacitor.

10. The filter of claim 1 wherein the input coupling and the output coupling are capacitance couplings.

11. The filter of claim 1 wherein the input coupling and the output coupling are tapped-line couplings.

12. The filter of claim 1 having a passband and further including a respective coupling capacitance in the corresponding side coupling region between neighboring resonators enabling control of the frequency of a pole of attenuation adjacent to the passband of the filter.

13. The filter of claim 12 further including at least one additional coupling copacitance to the respective side coupling region between neighboring resonators enabling control of the frequency of at least one additional pole of attenuation adjacent to the passband of the filter.

* * * * *